US009388626B2

(12) United States Patent
Gilbert et al.

(10) Patent No.: US 9,388,626 B2
(45) Date of Patent: Jul. 12, 2016

(54) DOOR SILL ASSEMBLY WITH SEALED ZONE FOR EXTERIOR DOORS

(71) Applicant: FORIMPEX INC., Notre-Dame-des-Pins (CA)

(72) Inventors: Claude Gilbert, St-Georges (CA); André Bilodeau, St-Georges (CA); Tetsuya Kobayashi, St-Georges (CA)

(73) Assignee: FORIMPEX INC., Notre-Dame-des-Pins (CA)

( * ) Notice: Subject to any disclaimer, the term of this patent is extended or adjusted under 35 U.S.C. 154(b) by 0 days.

(21) Appl. No.: 13/867,690

(22) Filed: Apr. 22, 2013

(65) Prior Publication Data

US 2013/0276376 A1 Oct. 24, 2013

(30) Foreign Application Priority Data

Apr. 20, 2012 (CA) ..... 2775167

(51) Int. Cl.

| | |
|---|---|
| ***E06B 1/70*** | (2006.01) |
| ***E06B 7/23*** | (2006.01) |
| ***E06B 7/26*** | (2006.01) |
| ***E06B 7/28*** | (2006.01) |
| ***E06B 1/52*** | (2006.01) |

(52) U.S. Cl.

CPC ... *E06B 1/70* (2013.01); *E06B 1/52* (2013.01); *E06B 7/2312* (2013.01); *E06B 7/2316* (2013.01); *E06B 7/26* (2013.01); *E06B 7/28* (2013.01)

(58) Field of Classification Search

CPC ..... E06B 1/70; E06B 1/52; E06B 7/2312; E06B 7/2316; E06B 7/28; E06B 7/26

USPC ..... 49/467–471, 479.1, 476.1, 504, 204.51, 49/209

See application file for complete search history.

(56) References Cited

U.S. PATENT DOCUMENTS

| | | | | |
|---|---|---|---|---|
| 3,854,246 | A * | 12/1974 | McAllister | 49/470 |
| 4,006,562 | A * | 2/1977 | Belanger et al. | 49/380 |
| 4,237,664 | A * | 12/1980 | Wilmes | 52/209 |
| 4,310,991 | A | 1/1982 | Seely | |
| 4,513,536 | A * | 4/1985 | Giguere | 49/470 |
| 4,716,683 | A * | 1/1988 | Minter | 49/479.1 |

(Continued)

OTHER PUBLICATIONS

Understanding 'The Rainscreen Principle', Metal Construction Association, Clapperton et al., Dec. 14, 2006 http://www.metalconstruction.org/pubs/pdf/mca07_Rainscreen.pdf.

*Primary Examiner* — Katherine Mitchell
*Assistant Examiner* — Marcus Menezes
(74) *Attorney, Agent, or Firm* — Norton Rose Fulbright Canada LLP

(57) ABSTRACT

A door sill assembly comprises a sill threshold defining an upper step portion and a lower step portion. A sweep is connected to a bottom of a door slab of a door, the sweep comprising deflectors projecting downwardly from the door slab. An outermost deflector is vertically aligned with and spaced apart from the lower step portion when the door is closed to form a pressure-equalized zone open to the exterior. A second deflector is vertically aligned and in contact with the upper step portion when the door is closed. A seal is positioned interiorly relative to the deflectors and is vertically aligned with the upper step portion to form a sealed zone with the second one of the deflectors and the upper portion when the door is closed.

19 Claims, 2 Drawing Sheets

(56) References Cited

U.S. PATENT DOCUMENTS

| | | | | |
|---|---|---|---|---|
| 4,807,397 | A * | 2/1989 | Doan | 49/498.1 |
| 5,067,279 | A * | 11/1991 | Hagemeyer | 49/471 |
| 5,174,065 | A * | 12/1992 | Schlicht | 49/489.1 |
| 5,687,508 | A | 11/1997 | Fitzhenry, Jr. et al. | |
| 6,052,949 | A * | 4/2000 | Procton et al. | 49/506 |
| 6,167,657 | B1 * | 1/2001 | Burge et al. | 49/496.1 |
| 6,219,971 | B1 * | 4/2001 | Headrick | 49/469 |
| 6,371,188 | B1 * | 4/2002 | Baczuk et al. | 160/92 |
| 6,871,448 | B1 | 3/2005 | Kline | |
| 7,472,516 | B2 * | 1/2009 | Pepper et al. | 49/468 |
| 7,669,369 | B2 | 3/2010 | Henry et al. | |
| 8,033,056 | B2 | 10/2011 | Wernlund et al. | |
| 8,132,370 | B2 | 3/2012 | Heppner | |
| 2006/0101719 | A1 * | 5/2006 | Purlee | 49/470 |
| 2009/0038231 | A1 | 2/2009 | Erbrect et al. | |

* cited by examiner

DOOR SILL ASSEMBLY WITH SEALED ZONE FOR EXTERIOR DOORS

CROSS-REFERENCE TO RELATED APPLICATIONS

The present application claims priority on Canadian Patent No. 2,775,167 filed Apr. 20, 2012, the entire contents of which is incorporated herein by reference.

FIELD OF THE APPLICATION

The present application relates to exterior doors such as doors providing access to the interior of a building from the outside, and more specifically to door sill assemblies for such exterior doors.

BACKGROUND OF THE ART

In exterior door assembly designs, the threat of water penetration is the greatest at the bottom of the door. Accordingly, to increase watertightness, the design of the sill threshold is crucial. Commonly used threshold designs, such as a flat sill, a fixed or adjustable threshold on an inclined sill approach, or a "dam" type threshold equipped with weep holes with an adjustable sweep, all manage water drainage, but may still allow some water infiltration. According to some new regulatory standards, the water penetration resistance test will be a primary source of concern because a minute water penetration on the interior of the door could result in a door sill assembly not meeting the standards.

There are other threshold designs, such as a "water retention sill", that feature a water retention structure at the sill portion, and a relatively high threshold, but such a configuration may not be suitable for using as an entrance door. Other components that contribute to the overall performance of the door system include sweep, pads (dust-plugs), weatherstrip, astragals, and the material of the door itself.

SUMMARY OF THE APPLICATION

It is an aim of the present disclosure to provide a door sill assembly that addresses issues associated with the prior art.

Therefore, in accordance with the present application, there is provided a door sill assembly comprising: a sill having an upper surface defining at least an upper step portion and a lower step portion, the upper step portion being positioned interiorly relative to the lower step portion; and a sweep connected to a bottom of a door slab of a door, the sweep comprising at least two deflectors projecting downwardly from the door slab, an outermost first one of the at least two deflectors being vertically aligned with and spaced apart from the lower step portion when the door is closed to form a pressure-equalized zone open to the exterior, a second one of the at least two deflectors being vertically aligned and in contact with the upper step portion when the door is closed, and a seal positioned interiorly relative to the at least two deflectors and being vertically aligned with the upper step portion to form a sealed zone with the second one of the at least deflectors and the upper portion when the door is closed.

Further in accordance with the present disclosure, there is provided a door system comprising: a door; a doorframe; and a door sill assembly comprising: a sill having an upper surface defining at least an upper step portion and a lower step portion, the upper step portion being positioned interiorly relative to the lower step portion; and a sweep connected to a bottom of a door slab of a door, the sweep comprising at least two deflectors projecting downwardly from the door slab, an outermost first one of the at least two deflectors being vertically aligned with and spaced apart from the lower step portion when the door is closed to form a pressure-equalized zone open to the exterior, a second one of the at least two deflectors being vertically aligned and in contact with the upper step portion when the door is closed, and a seal positioned interiorly relative to the at least two deflectors and being vertically aligned with the upper step portion to form a sealed zone with the second one of the at least deflectors and the upper portion when the door is closed.

DESCRIPTION OF PREFERRED EMBODIMENTS

Figure 1:
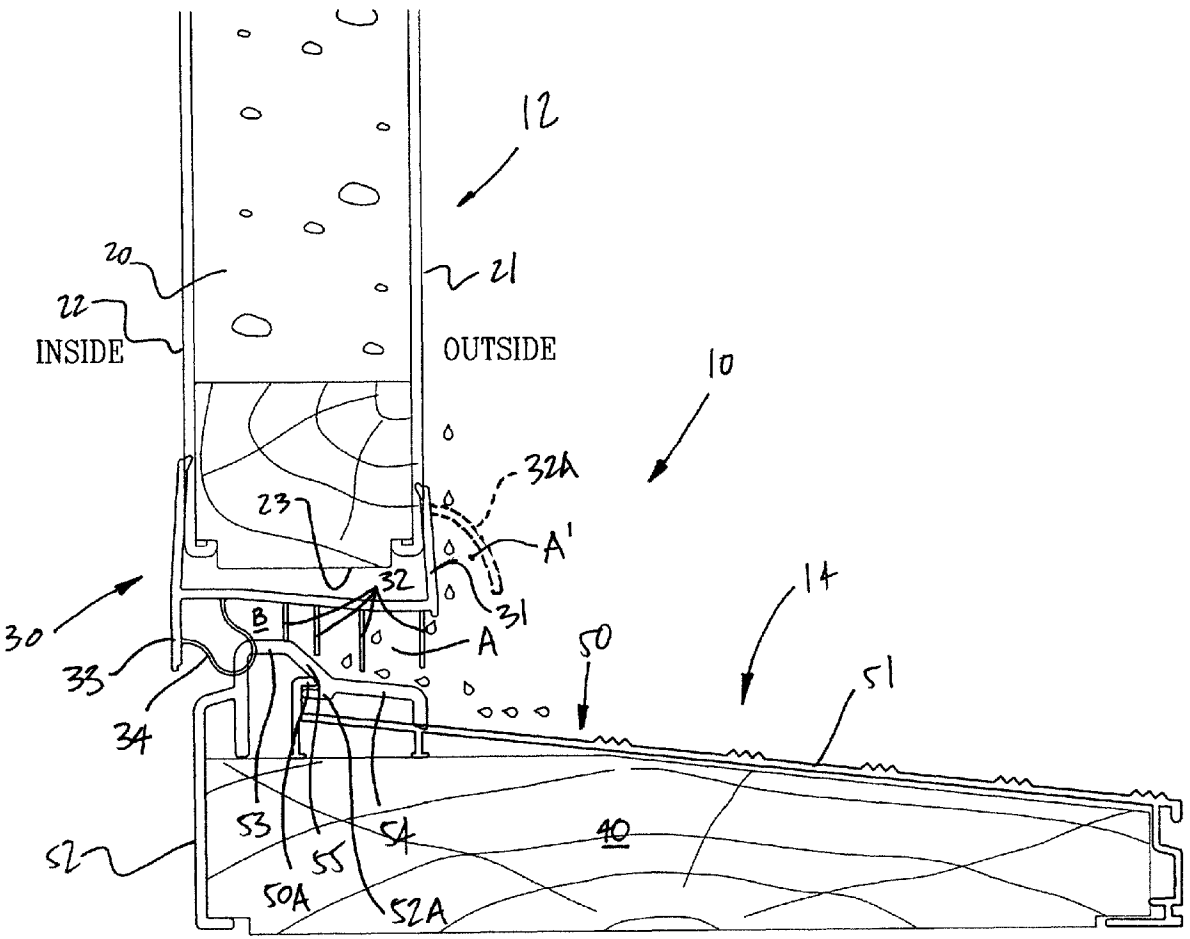
FIG. 1 is a door-slab sectional view of a door sill assembly in accordance with an embodiment of the present disclosure.
Figure 2:
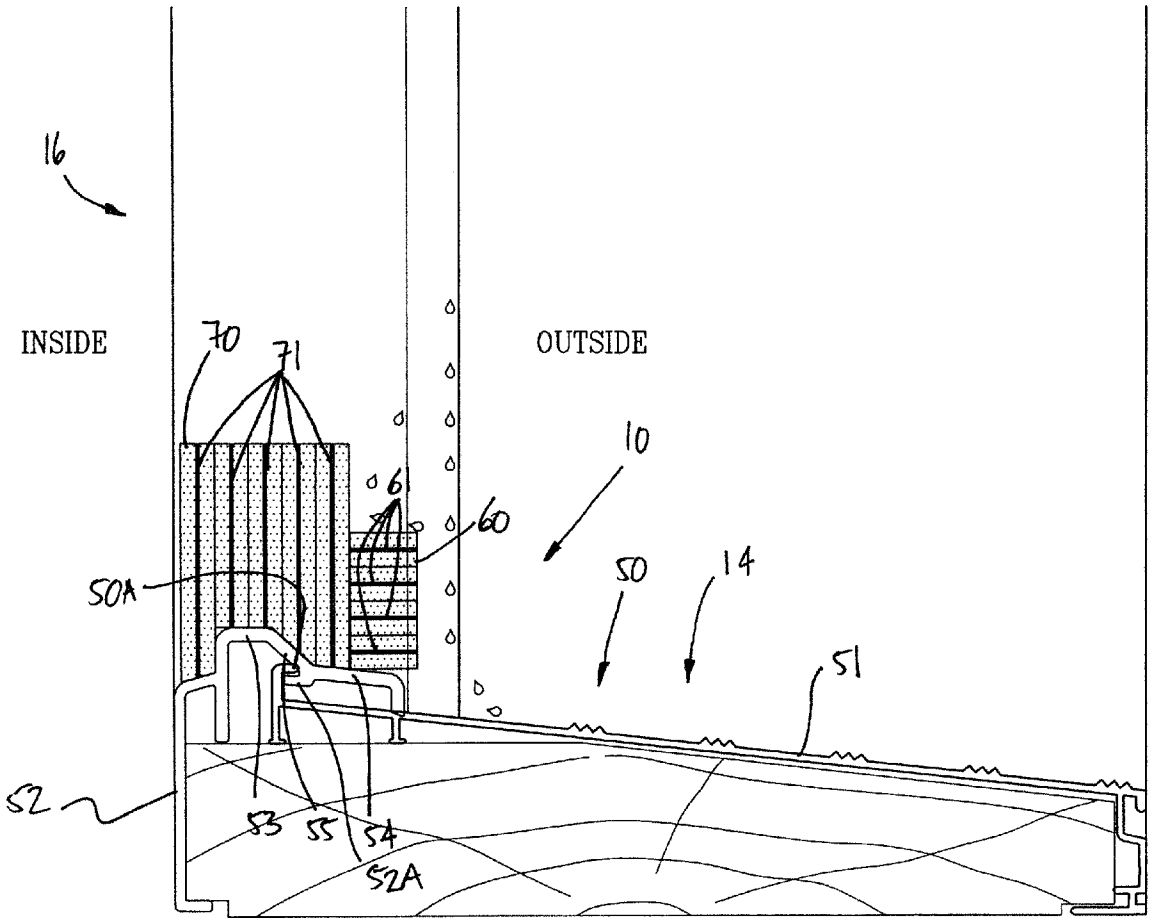
FIG. 2 is a jamb sectional view of the door sill assembly of FIG. 1.

Referring to the drawings and more specifically to FIG. 1, there is illustrated at 10 a door sill assembly in accordance with an embodiment of the present disclosure. The door sill assembly 10 is between a door 12 and a sill 14, and may have components in the jambs 16 (FIG. 2). The door 12 is of to type that is pivotally mounted to the doorframe so as to be pivoted between an open position, and a closed position as in FIG. 1. Such a door may be known as a hinged door, a leaf door, an entrance door, etc. Therefore, as illustrated in the figures, the door 12 may be between the inside and the outside of a building. Moreover, the door 12 typically pivots toward the interior to reach the open position, although the door 12 could pivot toward the exterior as well. Moreover, the door 12 could be fixed or sidelite.

The door 12 comprises a door slab 20 that is made of any appropriate material or combinations thereof such as wood, metals (e.g., steel), foam core, glass, etc. In FIG. 1, the door slab 20 is shown having a wooden frame, a foam core, with metal panels forming an exterior surface 21 and an interior surface 22, respectively oriented towards the outside and the inside of a dwelling. In the figures, the door slab 20 is shown as having a bottom edge surface 23. The bottom edge surface 23 is generally flat with end channels to receive part of the metal panels. The bottom edge surface 23 is separated from the sill 14 by a gap (i.e., a clearance or an intentional opening), allowing the pivoting movement of the door slab 20 between the closed position and the open position. The gap is filled with components of the door sill assembly 10, to limit infiltration of fluids through the gap when the door 12 is in the closed position.

A sweep 30 may cover the bottom edge surface 23 of the door slab 20. The sweep 30 may also be known as a cap assembly, a door shoe, a door bottom, etc. In the illustrated embodiment, the sweep 30 may be an extrusion of a polymeric material or metallic material that is sealingly attached to a bottom of the door slab 20 (glued, nailed, screwed, snapped, inserted and/or sealed, etc), extending along the full width (or most of the width) of the door slab 20. Alternatively, the door sweep 30 may be cast or molded. As shown in FIG. 1, the sweep 30 may have a U-shaped body 31, with an inner cavity of the U-shaped body 31 receiving the bottom of the door slab 20. Accordingly, the U-shaped body 31 allows the vertical adjustment of the sweep 30 relative to the ground (i.e., adjustment of size of the clearance), by varying the depth of insertion of the door slab 20 in the inner cavity of the U-shaped body 31. As alternatives to the U-shaped body 31, the sweep 30 may have a L-shaped body, or a flat body with minimum effect on the appearance of the exterior surface 21 of the door 12.

Deflectors 32 project downwardly from a bottom surface of the U-shaped body 31, and extend along the full width (or most of the width) of the door slab 20. The deflectors 32 may be known as leafs, wipers, etc. The deflectors 32 may be extruded integrally with the U-shaped body 31, or secured thereto. The deflectors 32 are made of a resilient and flexible waterproof material such as a polymer (the first two deflectors 32 from the exterior may each be a row of brushes) as they may need to deform when contacting the sill 14 during the closing or opening action of the door (for instance by being thinner than the walls of the U-shaped body 31). In FIG. 1, there is illustrated four of the deflectors 32, for instance made of extruded flexible PVC. The first of the deflectors 32 from the exterior generally lies in the same plane as the plane of the exterior surface 21 of the door slab 20. It is observed that the deflectors 32 may have different heights. The two first deflectors 32 from the exterior each have their bottommost edge below the bottommost edges of the two other deflectors 32. An additional deflector 32A may project toward the exterior forward from a plane of the exterior surface 21 of the door 12. The additional deflector 32A may be integral with the sweep 30 (e.g., extruded therewith) or added (e.g., glued, snapped, nailed, screwed, sealed, etc.), for instance on the vertical wall of the U-shaped body 31, or on the exterior surface 21 of the door slab 20. The additional deflector 32A may consist of a flexible or a rigid waterproof material such as a polymer, a row of brushes or any combined materials.

An interior strip 33 extends downwardly from the inside-facing surface of the U-shaped body 31. According to an embodiment, the interior strip 33 is integral with the U-shaped body 31. Moreover, the interior strip 33 may have a thickness similar to that of the U-shaped body 31, and therefore be less flexible than the deflectors 32. Indeed, as the interior strip 33 is positioned at the interior of the dwelling, and as the door 12 pivots to the interior to open in an embodiment, the interior strip 33 does not come in direct contact with the sill 14, and thus may not need to deform. A seal 34 (i.e., a gasket, a weatherstrip, a bulb seal) is located within the concavity formed by the combination of the bottom surface of the U-shaped body 31 and the interior strip 33. In the illustrated embodiment, the seal 34 is hollow and is made of a flexible and resilient material such as a rubber or like polymer. Alternatively, the seal 34 may be solid (i.e., not hollow), while remaining flexible and resilient. The interior strip 33 and seal 34 extend the full width (or most of the width) of the door slab 20. As explained hereinafter, the seal 34 is positioned to contact the sill 14 when the door is closed, thereby forming a generally airtight and watertight joint with the sill 14. According to an embodiment, the seal 34 is resilient and flexible to deform when contacting the sill 14, thereby increasing its contact surface with the sill 14.

Still referring to FIG. 1, the sill 14 is shown having a sill structural member 40. The sill structural member 40 is illustrated as being a wood plank, but may consist of any other appropriate material such as stone, metal, cement, etc. A combination of a sill approach 50 with sloping portion 51 and sill threshold 52 cover the structural member 40, or may even be used without any such structural member 40. The sloping portion 51 slopes towards the exterior, whereby water accumulating thereon drains toward the exterior. The upper surface of the sill approach 50 may have longitudinal ribs as illustrated, to provide traction to a person walking on the sloping portion 51.

The sill threshold 52 is shown as being connected to the sill approach 50, although the sill approach 50 and threshold 52 may be integrally formed into a single piece. According to the illustrated embodiment, the sill approach 50 and the threshold 52 respectively have interlocked hooks 50A and 52A extending the width of the door and forming an airtight and watertight joint. Both the sill approach 50 and the sill threshold 52 may be extruded, cast or molded members made of relatively rigid materials such as a metal. Other materials and manufacturing methods are considered as well. The sill approach 50 and the sill threshold 52 may be subjected to the weight of a person, whereby they must have some structural integrity to support such loads repeatedly without deforming.

The sill 14 has a two or more steps, as shown in FIG. 1 with the sill threshold 52 defines these two steps. In the embodiment of FIG. 1, the threshold 52 has an upper step portion 53 and a lower step portion 54, although the lower step portion 54 could be part of the sill approach 50. A transition portion 55 may be located between the upper step portion 53 and the lower step portion 54. The transition portion 55 slopes towards the exterior. Moreover, the top surfaces of both the upper step portion 53 and the lower step portion 54 may slope slightly toward the exterior as well, but with less steepness than the transition portion 55. In an embodiment, the transition portion 55 is substantially vertical.

The gap or clearance between door 12 and sill 14 is bound by the sweep 30 and the sill approach 50 and sill threshold 52. When the door is closed as in FIG. 1, the exterior-most deflectors 32 are in vertical alignment with the lower step portion 54. The bottommost edges of the deflectors 32 aligned with the lower step portion 54 are however spaced apart from an upper surface of the lower step portion 54. Moreover, these bottommost edges are vertically lower than a top surface of the upper step portion 53. Therefore, the exterior-most deflectors 32 act as a rain screen, and form with the lower step portion 54 a pressure-equalized clearance or drainage zone A. As the exterior-most deflectors 32 extend below the upper step portion 53, these deflectors 32 will efficiently prevent rain from reaching the upper step portion 53. The clearance between the bottommost edges of these deflectors 32 and the lower step portion 54 will ensure that the pressure-equalized clearance zone A generally remains at atmospheric pressure. As a result, water reaching the lower step portion 54 will naturally drain towards the exterior by the sloping arrangement of the lower step portion 54 and the sill approach 50, the water not being retained by any suctioning effect of the door sweep 30. As mentioned previously, the deflectors 32 are made of a flexible resilient material, whereby they will deform temporarily during the opening or closing action of the door when contacting the upper step portion 53.

In the embodiment of FIG. 1, the sill 14 is shown as being without an internal drainage surface: no weep holes, no drainage holes on the surfaces of the sill approach 50 or of the sill threshold 52. In the embodiment of FIG. 1, the sill approach 50 and the sill threshold 52 rely on the dead weight of water, and the sloping of their surfaces to drain water toward the outside.

When the door 12 is closed as in FIG. 1, the upper step portion 53 is in vertical alignment with an interior-most of the deflectors 32 and the seal 34. The interior-most deflector 32 has a given height so as to remain in contact with the upper step portion 53 when the door is closed. The seal 34 also contacts the upper step portion 53 when the door is closed. Accordingly, a sealed zone B is defined concurrently by at least one of the deflectors 32, the seal 34 and the upper step portion 53. The sealed zone B extends the full width of the clearance between the door 12 in the sill 14, and defines an air seal. The bottommost edge of the deflector 32 aligned vertically with the transition portion 55 is in close proximity to the top surface of the transition portion 55, thereby helping in preventing water from reaching the upper step portion 53.

It is observed that the sequence of pressure-equalized clearance zone A and sealing zone B from the outside to the inside does not extend beyond the thickness of the door slab 20. A supplemental clearance zone A' may be defined with the additional deflector 32A to the exterior the zone A. Moreover, as there are no weep holes, water retention cavities, etc, the height of the sill threshold 52 is relatively low.

It is pointed out that the assembly described above is well suited for doors pivoting to the inside of the building. It is however considered to use the door sill assembly 10 on doors opening toward the exterior. In such a case, the strip 33 may have suitable flexibility to allow such opening action. Other adjustments may also be made. As an example, the sill assembly 10 can be used for a fixed door, sidelite, and any other combined door.

Referring to FIG. 2, there is illustrated capillary traps within one of the jambs 16 (both jambs 16 may have such capillary traps). A cover of the jamb 16 to illustrate the capillary traps, and a bottom edge of the jamb cover may define a clearance with the top of the sill 14 to expose the capillary traps and thus allow them to perform a capillary action on water. The capillary traps comprise pile weatherstripping, i.e., pads with a silicone treatment and with fins. The pads absorb liquids, while the fins prevent water movement across pads. More specifically, a first series of pads 60 are positioned closer to the exterior of the dwelling. The pads 60 may have a few horizontal layers of barrier fins 61 (four fins in FIG. 2). The second series of pads 70 are closer to the inside of the dwelling. The pads 70 are shown as having a few vertical layers of barrier fins 71 (five barrier fins in FIG. 2), thereby blocking the capillary path from the exterior to the interior. Moreover, there may be a large enough opening between each row of piles to prevent an upward capillary action.

It is within the ambit of the present invention to cover any obvious modifications of the embodiments described herein, provided such modifications fall within the scope of the appended claims.

The invention claimed is:

1. A door sill assembly comprising:

a sill threshold having an upper surface defining at least an upper step portion and a lower step portion, the upper step portion being positioned interiorly and vertically higher relative to the lower step portion; and a sweep connected to a bottom of a door slab of a door, the sweep comprising at least two deflectors projecting downwardly from the door slab, a first one of the at least two deflectors being an outermost one of the deflectors relative to an exterior of the door and being vertically aligned with and spaced apart from the lower step portion and further not contacting the sill threshold when the door is closed to form a pressure-equalized zone open to the exterior of the door, a second one of the at least two deflectors being an air sealing deflector vertically aligned and in contact with the upper step portion when the door is closed, and a seal positioned interiorly relative to the at least two deflectors and being vertically aligned with the upper step portion, and a strip projecting downwardly from an interior portion of the sweep and contacting the seal when the door is closed; and a sealed zone formed with the second one of the at least two deflectors and the upper step portion when the door is closed.

2. The door sill assembly according to claim 1, wherein the outermost first deflector is generally coplanar with an exterior surface of the door slab.

3. The door sill assembly according to claim 1, wherein a bottom edge of the outermost first deflector is lower than an upper surface of the upper step portion.

4. The door sill assembly according to claim 1, wherein the sweep has a U-shaped body receiving therein a bottom of the door slab.

5. The door sill assembly according to claim 1, wherein the strip and the at least two deflectors are integral with the sweep.

6. The door sill assembly according to claim 5, wherein the at least two deflectors are thinner than the strip.

7. The door sill assembly according to claim 1, comprising two of the deflectors in vertical alignment and spaced apart relation with the lower step portion in the pressure equalized zone.

8. The door sill assembly according to claim 1, comprising a plurality of the deflectors in the pressure-equalized zone exteriorly positioned relative to the air sealing deflector.

9. The door sill assembly according to claim 1, further comprising a sill approach positioned outside of the sill threshold, the sill approach having an upper surface sloping towards the exterior of the door.

10. The door sill assembly according to claim 9, wherein the sill approach and the threshold have interlocked hooks therebetween forming a generally airtight and watertight joint.

11. The door sill assembly according to claim 1, wherein the upper surface of the sill threshold is without drainage holes or weep holes.

12. The door sill assembly according to claim 1, wherein a thickness of the combination of the pressure-equalized zone and the sealed zone is at most equal to a thickness of the door slab.

13. The door sill assembly according to claim 1, further comprising weatherstripping pads in jambs on opposite ends of the sill threshold, the weatherstripping pads being in fluid communication with at least one of the pressure-equalized zone or the sealed zone.

14. The door sill assembly according to claim 13, wherein outermost weatherstripping pads have horizontal fins.

15. The door sill assembly according to claim 13, wherein innermost weatherstripping pads have vertical fins.

16. The door sill assembly according to claim 1, wherein the sweep has any one of a U-shaped body, a L-shaped body or a flat body.

17. A door system comprising:

the door;

a doorframe with a sill and jambs; and the door sill assembly according to claim 1.

18. The door sill assembly according to claim 1, wherein the upper step portion and the lower step portion are generally horizontal, with a generally vertical surface between the lower step portion and the upper step portion, the pressure-equalized zone being vertically above the lower step portion and the generally vertical surface.

19. The door sill assembly according to claim 1, wherein the sweep is made of extruded flexible PVC.

* * * * *